US007228857B2

(12) United States Patent
Kim et al.

(10) Patent No.: US 7,228,857 B2
(45) Date of Patent: Jun. 12, 2007

(54) ELECTRIC OVEN WITH DOOR COOLING STRUCTURE

(75) Inventors: Wan Soo Kim, Gwangmyeong-si (KR); Yang Kyeong Kim, Bucheon-si (KR); Jong Sik Kim, Seoul (KR); Young Min Lee, Incheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/883,732

(22) Filed: Jul. 6, 2004

(65) Prior Publication Data

US 2005/0133019 A1 Jun. 23, 2005

(30) Foreign Application Priority Data

Dec. 17, 2003 (KR) ..... 10-2003-0092360

(51) Int. Cl.
*F23M 7/04* (2006.01)
*F24C 15/04* (2006.01)

(52) U.S. Cl. ..... 126/198; 126/273 R; 219/391

(58) Field of Classification Search ..... 126/198, 126/193, 190, 273 R, 275 E, 19 R, 21 R, 126/21 A; 219/391, 399
See application file for complete search history.

(56) References Cited

U.S. PATENT DOCUMENTS 3,889,100 A * 6/1975 Dills ..... 126/198
4,163,444 A * 8/1979 Drouin ..... 126/198
4,180,049 A * 12/1979 Carr et al. ..... 126/21 A
5,193,520 A * 3/1993 Gostelow et al. ..... 126/21 A

FOREIGN PATENT DOCUMENTS

| | | |
|---|---|---|
| DE | 25 33 539 A1 * | 2/1976 |
| DE | 10047016 | 4/2002 |
| EP | 0330727 | 9/1989 |
| EP | 0900985 | 3/1999 |
| EP | 1022517 | 7/2000 |
| FR | 2 818 360 A1 * | 6/2002 |

OTHER PUBLICATIONS

Translation of EP 0 900 985 A1 dated Feb. 2006 provided by the Translations Branch of the Scientific and Technical Information Center of the Untied State Patent and Trademark Office.*
Chinese Office action dated May 19, 2006.*

* cited by examiner

*Primary Examiner*—Josiah C. Cocks
(74) *Attorney, Agent, or Firm*—Greenblum & Bernstein, P.L.C.

(57) ABSTRACT

An electric oven with a door cooling structure includes a cavity formed in the case to provide a high temperature environment, a door for selectively opening and closing the cavity, inner, intermediate and outer panels provided in the door; an airflow shielding panel for blocking a space formed below the intermediate panel to guide introduced air upward; a door cover for blocking a top of the door, which is defined between the inner and outer panels, and a fan for applying negative pressure to gaps defined between the inner, intermediate and outer panels so that the panels can be cooled by the air flowing upward and downward in the gaps.

11 Claims, 6 Drawing Sheets

ELECTRIC OVEN WITH DOOR COOLING STRUCTURE

BACKGROUND OF THE INVENTION

1. Field of the Invention

The present invention relates to an electric oven, and more particularly, to an electric oven with a door cooling structure that can uniformly quickly cool the door to which high heat is transmitted from an inside of a cavity. The present invention further relates to an electric oven that is structured to prevent foreign substances from being introduced in the door through a top of the door.

2. Description of the Related Art

Generally, an electric oven is a device that is used in a specific condition requiring a high temperature to heat food by heating an inside of a cavity using an electric source applied to an exterior side.

Since an internal temperature of the electric oven is increased to about 500–600° C., the user may inadvertently get burned or the device may be damaged. To prevent this, a special structure has been added to the oven. Particularly, an insulating layer must be provided on an outer wall of the cavity in order to prevent high heat from being transmitted to an exterior side. In addition, a door opened/closed to load/unload food is provided with a cooling/insulating structure. European Patent No. EP0330727 to Compagne discloses a food baking oven for set-in installation in modular pieces of kitchen furniture. In this patent, the door is formed of three glass panels. Air is introduced through a lower end of a gap between the panels and exhausted through an upper end of the gap, thereby realizing a natural cooling structure through natural convection current.

However, since the air should be exhausted through the small gap between the panels, the cooling efficiency is lowered and the foreign substances may be introduced between the panels through the gap.

Furthermore, the natural convection current cannot provide the sufficient cooling effect, deteriorating the safety for the user.

Furthermore, since a hot wind used for cooling the door is directed toward the handle of the door, it is inconvenient to use the handle that is heated by the hot wind.

In addition, since the air is not uniformly introduced throughout the whole surface of the door, a temperature difference may be incurred on the door, causing the door to be damaged.

SUMMARY OF THE INVENTION

Accordingly, the present invention is directed to a door for an electric oven, which substantially obviate one or more problems due to limitations and disadvantages of the related art.

It is a first object of the present invention to provide an electric oven with a door cooling structure that can quickly sufficiently cool down panels forming the door and enhance the safety in use.

It is a second object of the present invention to provide an electric oven with a door cooling structure that is designed not to direct a hot wind to a door handle.

It is a third object of the present invention to provide an electric oven with a door cooling structure that can uniformly cool whole surfaces of panels forming the door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an electric oven with a door cooling structure, comprising: a case; a cavity formed in the case to provide a high temperature environment; a door for selectively opening and closing the cavity; inner, intermediate and outer panels provided in the door; an airflow shielding panel for blocking a space formed below the intermediate panel to guide introduced air upward; a door cover for blocking a top of the door, which is defined between the inner and outer panels; and a fan for applying negative pressure to gaps defined between the inner, intermediate and outer panels so that the panels can be cooled by the air flowing upward and downward in the gaps.

In another aspect of the present invention, there is provided an electric oven with a door cooling structure, comprising: a cavity having a front opening through which food is loaded and unloaded; a door for opening and closing the front opening of the cavity; an inner panel disposed in the door, the inner panel having a lower end, a portion of which is opened to exhaust hot air; an intermediate panel disposed in the door, the inner panel having an opened upper end for altering a flow direction of air; an outer panel disposed in the door, the outer panel having a lower end, a portion of which is opened to introduce outer air; and a door cooling fan provided on a lower portion of the cavity to allow the air to be introduced through the inner panel.

In still another aspect of the present invention, there is provided an electric oven with a door cooling structure, comprising: a cavity; and a door having a plurality of panels, the door being structured such that air is introduced through a portion of a sectional horizontal plane of the door and the air introduced is exhausted through another portion of the sectional horizontal pane of the door, thereby uniformly cooling a whole surface of the panels.

According to the present invention, the door can be uniformly quickly cooled, while being prevented from being damaged.

Furthermore, foreign substances such as food remnants can be introduced into the door through an upper portion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention, are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
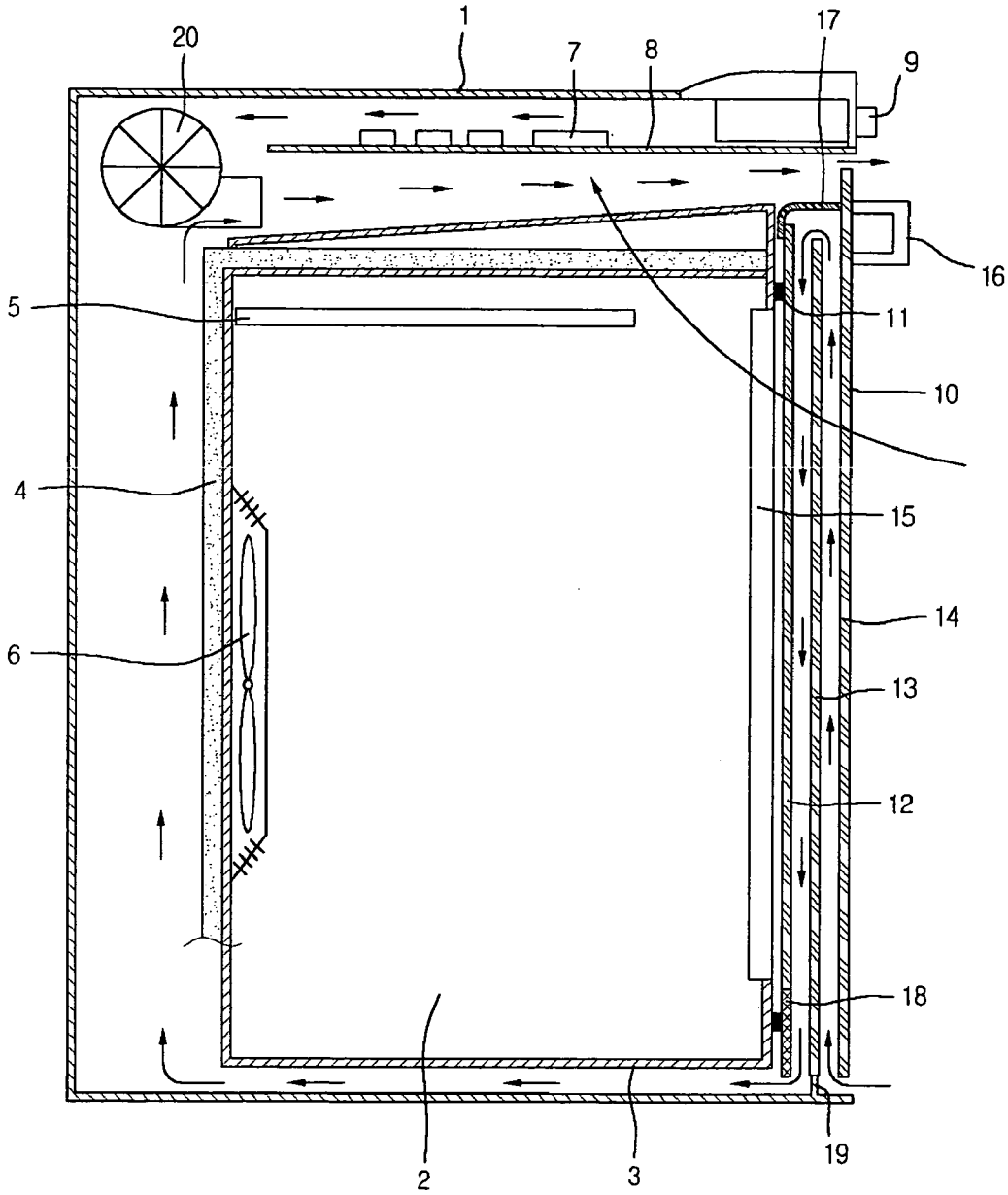
FIG. 1 is a sectional view of an electric oven with a door cooling structure according to a first embodiment of the present invention.

FIG. 1 shows an electric oven with a door cooling structure according to a first embodiment of the present invention.

Referring to FIG. 1, an electric oven comprises a case 1, a cavity 2 defined by a cavity wall 3 disposed in the case, an insulating layer 4 enclosing an outer surface of the cavity wall 3, and a door 10 for selectively opening/closing a front opening 15 of the cavity 2.

The electric oven further comprises a front operation panel 9, an electric unit 7 required for operating the electric oven, and a blower fan 20 for forcedly flowing air used for cooling the electric unit 7.

The door 10 comprises a door frame 18, inner, intermediate and outer panels 12, 13 and 14 disposed in the door frame 18, a sealing portion 11 formed on a portion of the door 10, which contacts the cavity wall 3 to insulate an inside of the cavity 2, a door cover 17 for sealing an upper portion of the door 10, and a door handle 16.

As a heat source for heating the inside of the cavity 2, a heater 5 and a convention current fan 6 are provided. A variety of heaters may be used for the electric oven.

In order to guide airflow into the door, an airflow shielding panel 19 is formed between one side ends of the intermediate panel 13 and an inner wall of the case 1. Preferably, the panels are formed of transparent glass so that the user can observe the inside of the cavity 2.

The operation of the present invention will be described hereinafter.

After the food is loaded in the cavity 2 and the heater 5 is operated to heat the food. At this point, by the operation of the heater 5 and the convection current fan 6, the temperature of the inside of the cavity 2 is increased to heat the door 10 and the electric unit 7. Therefore, in order to cool the door 10 and the electric unit 7, the blower fan 20 is operated.

When the blower fan 20 is operated, negative pressure is formed to introduce the air from a lower portion of the door 10. The introduced air is guided by the airflow shielding panel 19 to be directed to an upper side of the door 10 through a gap defined between the intermediate and the outer panels 13 and 14. The air directed to the upper portion of the door 10 is blocked by the door cover 17 and is directed to the lower portion of the door 10 through a gap defined between the inner and intermediate panels 12 and 13. By the dual-convection current where the airflows upward and downward, the panels 12, 13 and 14 are effectively cooled. The air directed to the lower portion of the door 10 is directed to a rear portion of the electric oven through a gap between the cavity wall 3 and the case 1 and is then further directed to a rear-upper portion of the oven, after which it is exhausted through the upper portion of the door 10 along the airflow guide 8 by the blower fan 20.

The air exhausted by the blower fan may include air introduced through a sidewall of the door and used for cooling the electric unit 7 and the operating panel 9.

As described above, since the air is directed upward in the gap defined between the outer and intermediate panels 14 and 13 and is directed downward in the gap between the intermediate and inner panels 13 and 12, the door cooling efficiency can be improved. In addition, the air flowing along the gaps between the panels 12, 13 and 14 generates a forced convection current by the negative pressure formed by the blower fan 20, it can act together with the natural convection current formed by warm air in the door, further enhancing the cooling efficiency. Furthermore, since the upper portion of the door 10 is sealed by the door cover 17, the foreign substances cannot be introduced into the door 10.

Second Embodiment

Figure 2:
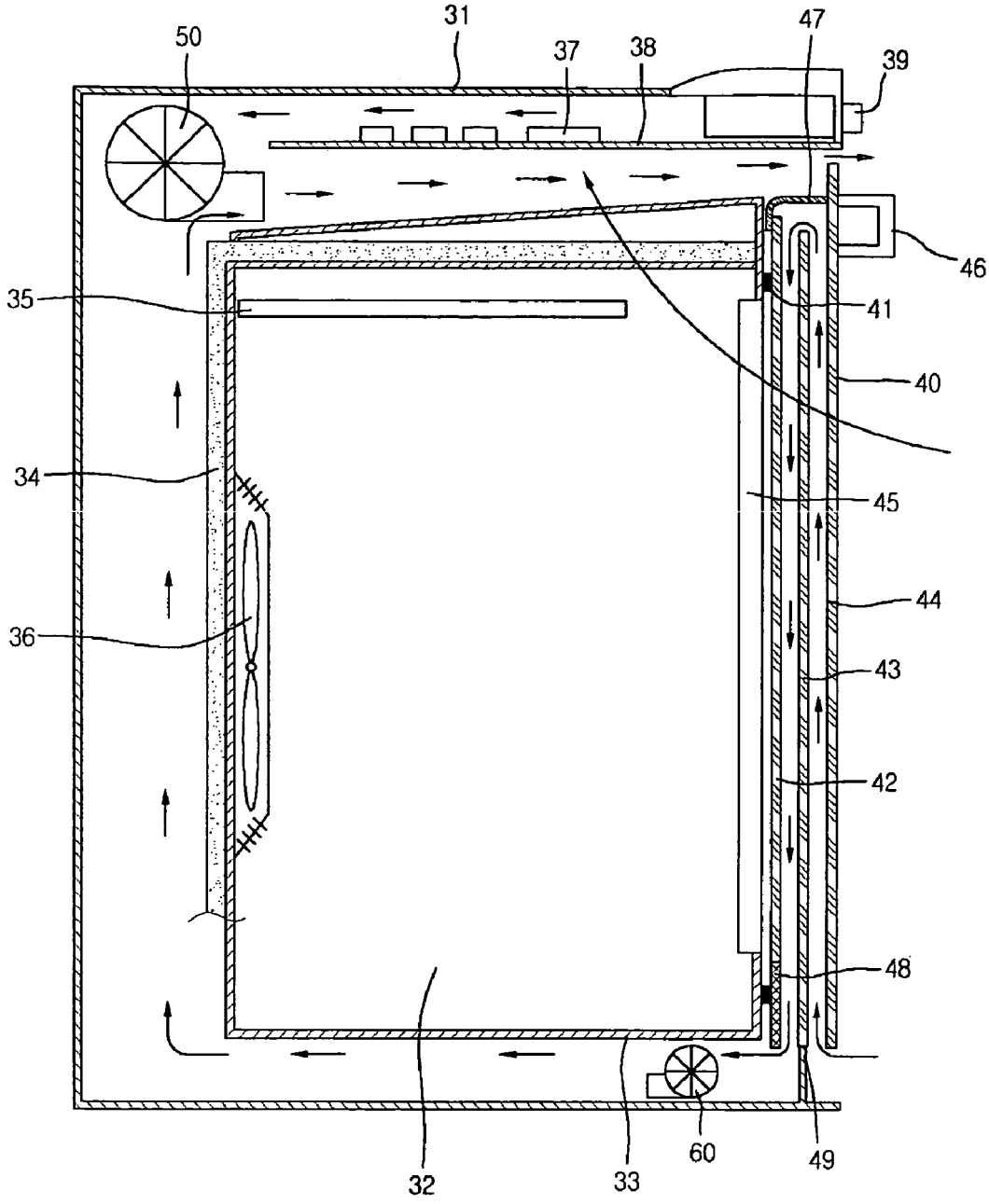
FIG. 2 is a sectional view of an electric oven with a door cooling structure according to a second embodiment of the present invention.

FIG. 2 shows an electric oven with a door cooling structure according to a second embodiment of the present invention. In this embodiment, a description of identical portions to those of the first embodiment will not be described, but only a different will be described hereinafter.

Referring to FIG. 2, in order to enhance the door cooling efficiency, a door cooling fan 60 is further provided between a lower portion of a cavity wall 33 and a case 31. Preferably, the cooling fan 60 is provided on a front portion of a gap between the cavity wall 33 and the case 31 so that enhanced negative pressure can be applied to gaps between panels 42, 43 and 44. In addition, an exhaust side of the cooling fan 60 is designed to be directed rearward of the oven so that a strong, speedy wind can be generated between the cavity wall 33 and the case 31.

As described above, since the enhanced negative pressure is applied to the inside of the door, the more strong, speedy wind is applied to the gaps between the panels 42, 43 and 44, thereby more quickly cooling the door 40.

The reference numerals that are not described in this embodiment refer parts having functions and locations that are identical to corresponding ones described in the first embodiment. The reference numerals of this embodiment are formed by adding 30 to each of the reference numerals indicating the corresponding parts in the first embodiments.

Third Embodiment

FIGS. 3 through 7 show an electric oven with a door cooling structure according to a third embodiment of the present invention.

This embodiment is identical to the second embodiment except for a method and structure for controlling airflow for cooling the door.

Figure 3:
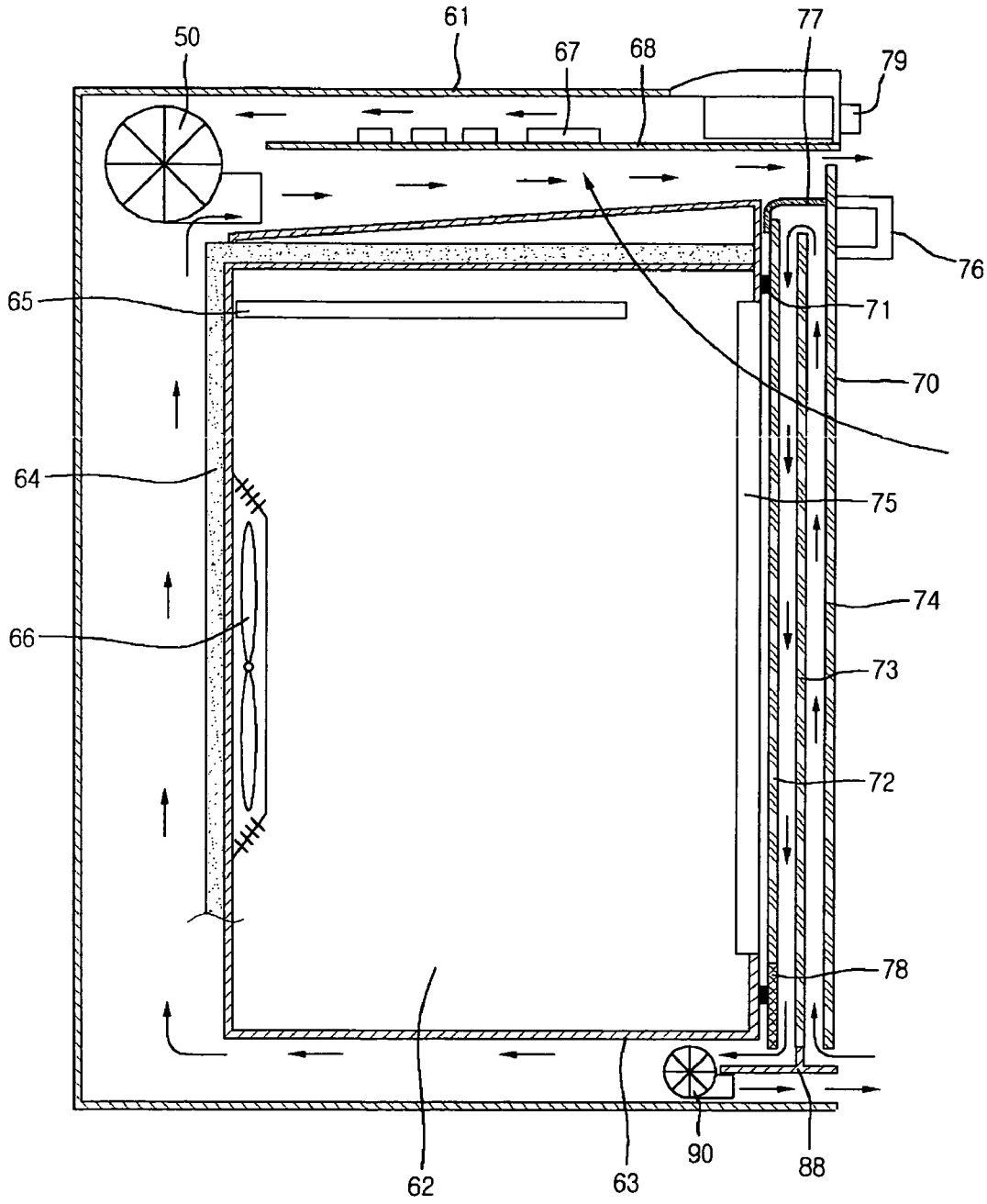
FIG. 3 is a sectional view of an electric oven with a door cooling structure according to a third embodiment of the present invention.

Referring first to FIG. 3, in order to enhance the door cooling efficiency, a door cooling fan 90 is disposed between a cavity wall 63 and a case 61 and an airflow guide 88 for exhausting air from the cooling fan 90 to an exterior side is provided. Preferably, the cooling fan 90 is provided on a front portion of a gap defined between the cavity wall 63 and the case 61 so that enhanced negative pressure can be applied to gaps between the panels 72, 73 and 74. In addition, an exhaust side of the cooling fan 90 is designed to be directed rearward of the oven so that a strong, speedy wind can be generated between the cavity wall 63 and the case 61.

The air used for cooling the inside of the door 70 is exhausted to the exterior side through a lower portion of the door.

The reference numerals that are not described in this embodiment refer parts having functions and locations that are identical to corresponding ones described in the second embodiment. The reference numerals of this embodiment are formed by adding 30 to each of the reference numerals indicating the corresponding parts in the second embodiments.

Figure 4:
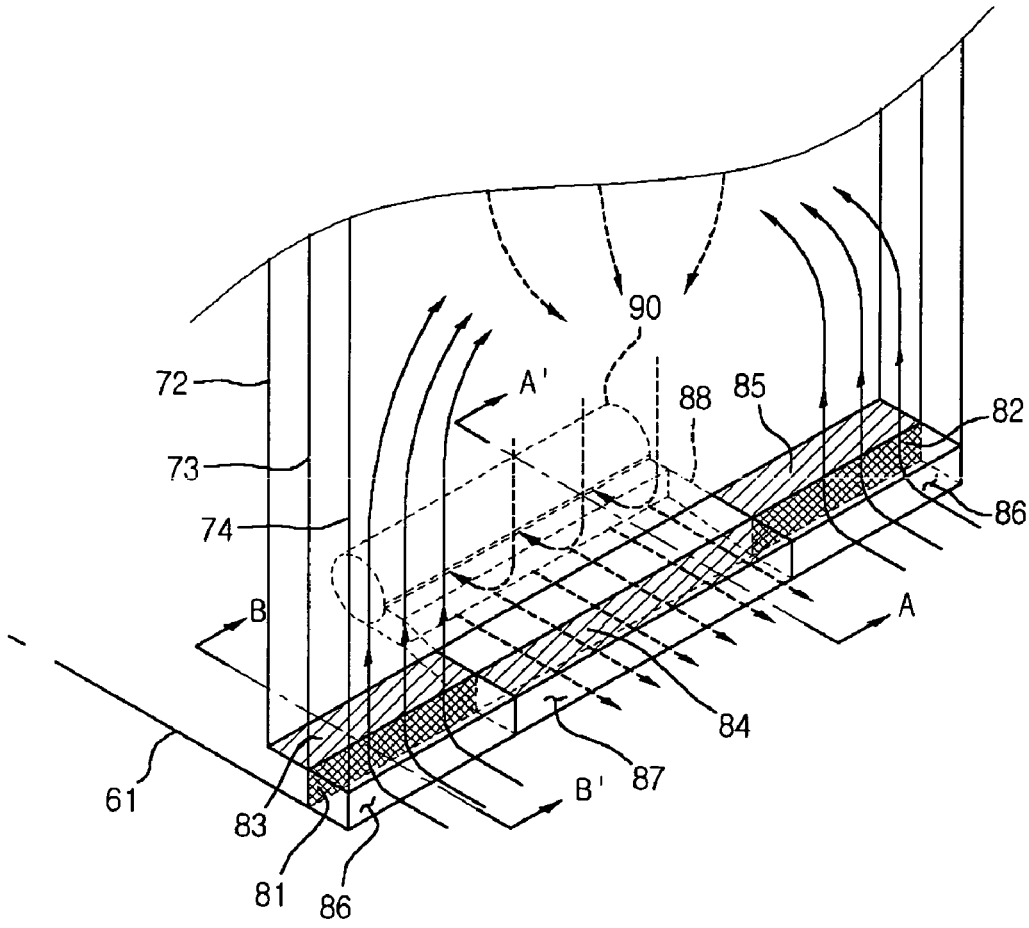
FIG. 4 is a perspective view of a lower portion of an electric oven depicted in FIG. 3.

Referring to FIG. 4, the door 70 is comprised of the inner, intermediate and outer panels 72, 73 and 74. Air inlets 86 are formed on opposite ends of a space defined between a lower end of the door 79 and a bottom of the case 61 and an outlet 87 for exhausting the air used for cooling the door 70 is formed on a middle portion of the space. That is, the air is introduced into the door 70 through the opposite ends of the space and exhausted out of the door 70 through the middle portion of the space.

To make the air introduced into the door 70, an airflow guide 88 is defined by a barrier shield formed between the case 61 and the door 70 and extending to a front portion of the door cooling fan 90 and first and second intake air shielding panels 81 and 82 for blocking opposite lower ends of a gap defined between the inner and intermediate panels 72 and 73. In order to prevent the air exhausted through the outlet 87 and the air introduced from the inlet 86 from being mixed with each other, first and second shielding door frames 83 and 85 are formed on both lower ends of the gap defined between the inner and intermediate panels 72 and 73, and a third shield door frame 84 formed on a lower middle portion of the gap defined between the outer and intermediate panels 74 and 73.

The first, second and third shield door frames 83, 85 and 84 may be formed as a portion of the door frame.

The airflow in the door will be described hereinafter with reference to FIGS. 5 and 6.

Figure 5:
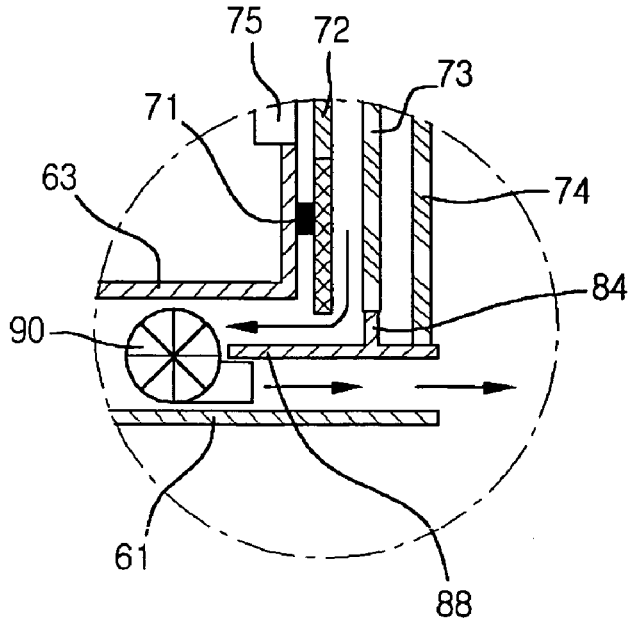
FIG. 5 is a sectional view taken along line A'—A' of FIG. 4.
Figure 6:
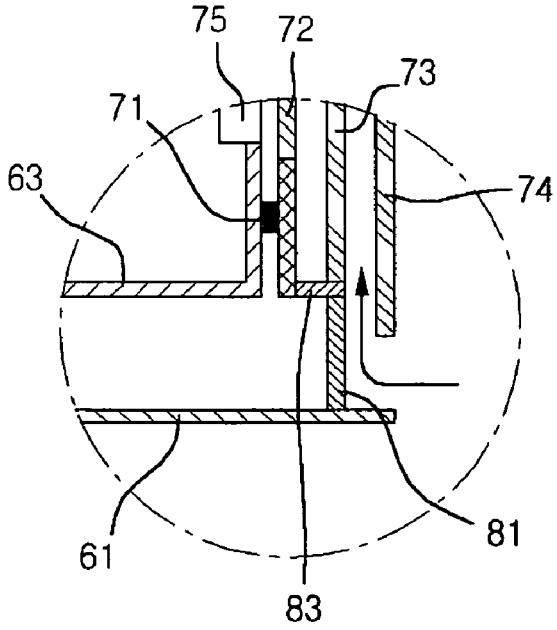
FIG. 6 is a sectional view taken along line B'—B' of FIG. 4.

FIG. 5 is a sectional view taken along line A'—A' of FIG. 4, illustrating an air exhaust structure of the door, and FIG. 6 is a sectional view taken along line B—B' of FIG. 4, illustrating an air intake structure of the door.

Referring to FIGS. 5 and 6, outer air is introduced through opposite ends of the gap between the outer and intermediate panels 74 and 73. At this point, to guide the introduced air into the door and prevent the introduced air from being directed into the oven, the first and second intake air shielding panels 81 and 82 are provided. In addition, since the middle portion of the gap between the outer and intermediate panels 74 and 73 are blocked by the third shielding door frame 84, the outer air is not introduced through the middle portion.

The air introduced through the opposite ends of the gap between the outer and intermediate panels 74 and 73 is directed upward to cool the panels and is then blocked by the door cover 77. Then, the blocked air is directed downward through a gap defined between the intermediate and inner panels 73 and 72. At this point, the panels may be also cooled by natural convection current. The air directed downward is sucked by the door cooling fan 80 through a lower middle portion of the gap between the intermediate and inner panels 73 and 72. At this point, to prevent the air from being exhausted to the exterior side through the opposite end of the gap between the panels 72 and 73, the first and second shielding door frames 83 and 85 are provided. Since the flow direction of the air is limited by the shielding door frames 83 and 85, all of the air used for cooling the door is sucked by the door cooling fan 80.

The air sucked by the door cooling fan 80 is directed along the airflow guide 88 and is then exhausted through the outlet 87.

According to this embodiment, since the door cooling is more quickly realized and the cooling state of the door is maintained for a long time, the convenience and safety for the user can be further enhanced.

Figure 7:
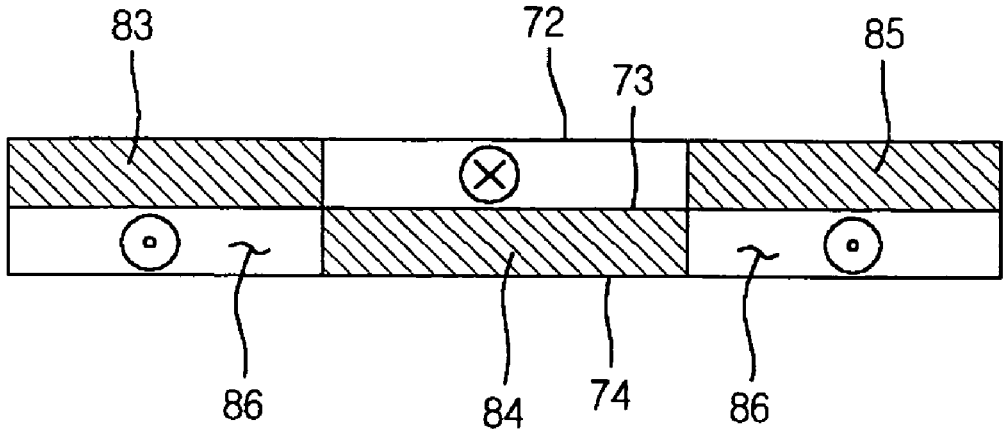
FIG. 7 is a horizontal sectional view of a door depicted in FIG. 3.

FIG. 7 shows a horizontal sectional view of the door depicted in FIG. 3.

Referring to FIG. 7, the shielding door frames 83, 84 and 85 limits the flow of the air. The outer air is introduced in the upward direction through the inlets 86 defined on the opposite sides of the door and exhausted through the outlet formed on the middle portion of the door. The arrows indicate the flow direction of the air.

As described above, since the air is introduced through the opposite ends of the door and is then exhausted through the middle portion of the door, the air uniformly contacts a whole area of the door, thereby uniformly cooling the whole surface of the door. That is, when it is assumed that a low end of the door is a horizontal line, since the air is introduced through a portion of the horizontal line and is then exhausted through another portion of the horizontal line, the air circulation in the door is enhanced, thereby uniformly cooling the whole surface of the door.

According to the present invention, since the air forcedly flows in a dual-direction, the temperature of the outer surface of the door can be effectively reduced. Furthermore, the air circulation is quickly realized in the door, the whole surface of the door can be uniformly cooled down.

Furthermore, since the upper portion of the door is sealed by the door cover, no foreign substances can be introduced into the door.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An electric oven with a door cooling structure, comprising:

a case;

a cavity formed in the case to provide a high temperature environment;

a door selectively opening and closing the cavity;

inner, intermediate and outer panels provided in the door;

a fan configured to apply negative pressure to gaps defined between the inner, intermediate and outer panels so that the panels can be cooled by the air flowing upward and downward in the gaps;

an airflow shielding panel formed below the intermediate panel, the airflow shielding panel having an outlet provided on a middle portion thereof to exhaust the air flowing upward and downward in the gaps to an outside of the oven; and a plurality of inlets provided on opposite sides below the outer panel to guide outer air upward into the gaps between the intermediate and outer panels.

2. The electric oven according to claim 1, further comprising a door cover that blocks a top of the door and is provided between the inner and outer panels.

3. The electric oven according to claim 1, wherein the air introduced into the inlets is directed to an inside of the oven through a lower end of the door.

4. The electric oven according to claim 1, further comprising a blower fan cooling an electric unit of the electric oven.

5. The electric oven according to claim 1, wherein the fan is disposed on a lower-front part of a space between a cavity wall and the case.

6. The electric oven according to claim 1, further comprising a shielding door frame that blocks a portion of a gap between the inner and intermediate panels.

7. The electric oven according to claim 1, wherein the air is introduced into the door through a first portion of a lower end of the door and is exhausted through a second portion of the lower end of the door, the first portion of the lower end of the door not corresponding horizontally with the second portion of the lower end of the door.

8. An electric oven with a door cooling structure, comprising:

a cavity having a front opening through which food is loaded and unloaded;

a door opening and closing the front opening of the cavity;

an outer panel disposed in the door, the outer panel having a lower end, a portion of which is opened to introduce outer air;

an intermediate panel disposed in the door, the intermediate panel having an opened upper end altering a flow direction of air;

an inner panel disposed in the door, the inner panel having a lower end, a portion of which is opened to exhaust hot air;

a door cooling fan provided on a lower-rear portion of the inner panel to guide the hot air to an inside of the electric oven and to exhaust the hot air to an outside of the electric oven; and an airflow guide member disposed in a lower portion of the intermediate panel to guide the hot air through the door cooling fan to the outside of the electric oven.

9. The electric oven according to claim 8, wherein the cooling fan is provided on a front portion of a gap defined between a cavity wall and the case.

10. The electric oven according to claim 8, wherein the airflow guide is defined by a barrier shield formed between the case and the door.

11. The electric oven according to claim 8, further comprising a blower fan that cools an electric unit of the electric oven.

* * * * *